United States Patent [19]

Prizio et al.

[11] Patent Number: 5,050,493

[45] Date of Patent: Sep. 24, 1991

[54] BI-DIRECTIONALLY DRAINING PORE FLUID EXTRACTION VESSEL

[75] Inventors: Joseph Prizio, Boulder; Alexander Ritt, Lakewood; Timothy E. Mower, Wheat Ridge; Lonn Rodine, Arvada, all of Colo.

[73] Assignee: The United States of America as represented by the Secretary of Interior, Washington, D.C.

[21] Appl. No.: 490,898

[22] Filed: Mar. 6, 1990

[51] Int. Cl.[5] ..... B30B 9/02

[52] U.S. Cl. ..... 100/106; 73/38; 73/76; 100/116

[58] Field of Search ..... 100/71-73, 100/104, 106, 110, 116, 125, 240, 245, 37; 73/38, 73, 76

[56] References Cited

U.S. PATENT DOCUMENTS

| | | | |
|---|---|---|---|
| 533,871 | 2/1895 | Drummond | 100/73 X |
| 2,331,126 | 10/1943 | Loomis | 100/73 X |
| 2,539,355 | 1/1951 | Reichertz | 73/38 |
| 2,705,418 | 4/1955 | Reichertz et al. | 73/38 |
| 3,216,242 | 11/1965 | Eyrich | 73/38 |
| 3,230,865 | 1/1966 | Hibbel et al. | 100/71 X |
| 3,612,036 | 9/1952 | Angona | 73/38 |
| 3,828,444 | 8/1974 | Kopp | 100/73 X |
| 4,371,376 | 2/1983 | Dick, Jr. | 100/116 X |
| 4,676,079 | 6/1987 | Czauderna | 100/116 X |
| 4,697,457 | 10/1987 | Fochtman et al. | 73/76 X |
| 4,749,054 | 6/1988 | Virtanen et al. | 73/76 X |

FOREIGN PATENT DOCUMENTS

| | | | |
|---|---|---|---|
| 148387 | 2/1904 | Fed. Rep. of Germany | 100/106 |

OTHER PUBLICATIONS

"Triaxial-Compression Extraction of Pore Water from Unsaturated Tuff, YUCCA Mountain Nev.", Yang et al., Water Resources Investigation Report 88-4189, U.S. Geological Survey, Denver, Colo., 1988.

*Primary Examiner*—Harvey C. Hornsby
*Assistant Examiner*—Stephen F. Gerrity
*Attorney, Agent, or Firm*—E. Philip Koltos

[57] ABSTRACT

The invention is used to extract pore fluid from porous solids through a combination of mechanical compression and inert-gas injection and comprises a piston for axially compressing samples to force water out, and top and bottom drainage plates for capturing the exuded water and using inert gas to force water to exit when the limits of mechanical compression have been reached.

2 Claims, 1 Drawing Sheet

BI-DIRECTIONALLY DRAINING PORE FLUID EXTRACTION VESSEL

BACKGROUND OF THE INVENTION

1. Field of the Invention

This invention pertains to an apparatus for extracting pore fluids from porous solids to determine the suitability for a potential repository to store high-level radioactive wastes. Pore fluids are necessary for chemical analysis to help characterize the local hydrologic system and to evaluate the potential interaction of pore gas and water with waste canisters.

2. Background of the Prior Art

The U.S. Geological Survey (USGS), which has been conducting hydrologic site investigations at Yucca Mountain, Nev., has selected mechanical compression as the method for extracting pore fluid from unsaturated rock. The radioactive wastes would be placed within the thick section of unsaturated volcanic tuff. The physics of fluid flow in thick, fractured-rock unsaturated zones is not well understood. Established techniques are lacking for testing and evaluating this hydrological system. The use of chemical analysis of pore gas and water should help to better understand this hydrologic system.

The USGS, in a report "Triaxial-Compression Extraction of Pore Water from Unsaturated Tuff, Yucca Mountain, Nev." by In C. Yang et al., Water Resources Investigation Report 88-4189, U.S. Geological Survey, Denver, Colo., 1988, shows that tests performed with prior art equipment on similar samples produced less success than the instant invention. For example, testing failed to yield water from samples having water contents below 13 percent. The equipment was a biaxial stress chamber in which differential axial and lateral pressures were applied. The resulting stress state is less favorable to that imposed in a one-dimensional compression device since it induces high shearing stresses, which cause stiff particulate solids to dilate and/or rupture. Furthermore, gas injection was not used to recover residual water when the limits of mechanical compression were reached.

To extract any pore water, the stress levels must exceed the forces holding water within the pores. Therefore, only a certain range of compressive stress will yield a pore water that has suitable composition for chemical analyses. For example, one prior art study concluded that of the two adsorbed molecular water layers on a vermiculite clay, the water layer farthest away from the clay particle required 120 MPa hydrostatic stress for removal, whereas the closer water layer required 520 MPa hydrostatic stress for removal. These experimental extraction stresses matched predictions determined theoretically from water-adsorption curves of vermiculite. Another prior art test compressed sodium-bentonite clay and determined that there was an abrupt increase in the extraction of electrolyte-deficient adsorbed water at stresses greater than 59 MPa. They also concluded that the threshold for removing adsorbed water from sodium bentonite was a function of the dissolved-solids concentration of the pore water. When less mineralized or interstitial water with a minimal dissolved-solids concentration was used, smaller stresses affected the composition of the extracted water.

One-dimensional compression is not an uncommon tool for extracting pore fluids from porous solids, however, none of the prior art devices use bidirectional drainage or gas injection.

SUMMARY OF THE INVENTION

The principal utility of the bidirectionally draining pore-fluid extraction vessel is that it extracts pore fluids from porous solids through a combination of one-dimensional mechanical compression and inert gas injection. Analyses of the fluids satisfy various informational needs in scientific, environmental, and engineering studies and applications.

Therefore, there is a need for a simple, rugged, and accurate test device for extracting chemically unaltered pore fluids for analyses such as isotopic age dating, isotope-ratio determinations, and chemical-concentration analyses.

It is therefore an object of the invention to provide a device to extract pore fluids from porous solids.

It is yet another object of the invention to provide a bidirectionally draining pore-fluid extraction vessel which extracts pore-fluids from porous solids through a combination of one-dimensional mechanical compression and inert gas injection.

Still another object of the invention is to provide a pore-fluid extraction device utilizing gas injection to force pore water to exit when the limits of mechanical compression have been reached.

These and other objects of the invention will become apparent to those skilled in the art to which the invention pertains when taken in light of the annexed drawings.

DESCRIPTION OF THE PREFERRED EMBODIMENT OF THE INVENTION

Figure 1:
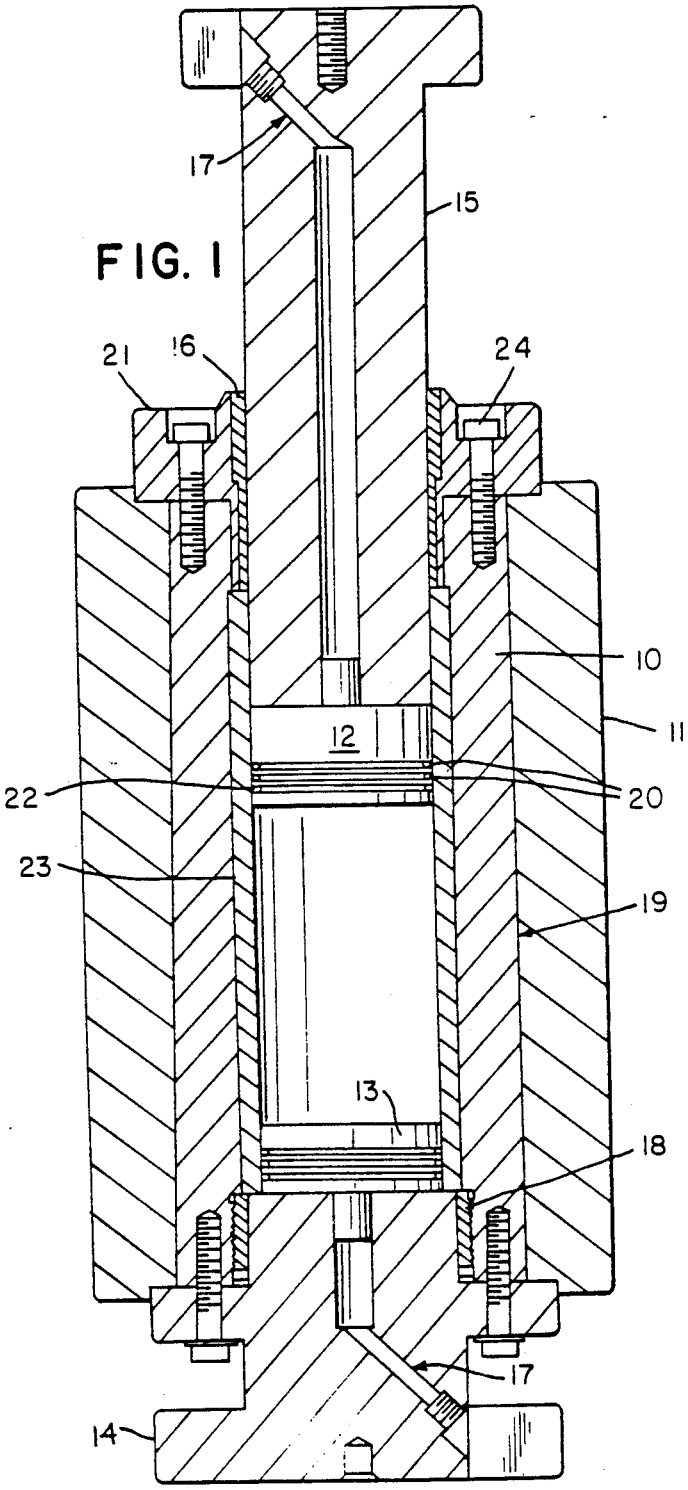
FIG. 1 is a perspective view, partially in section, of the pore-fluid vessel.
Figure 3:
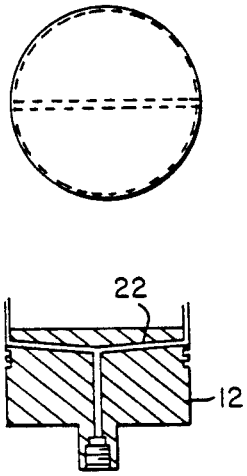
FIG. 3 shows sectional and plan views of the top drainage plate.
Figure 2:
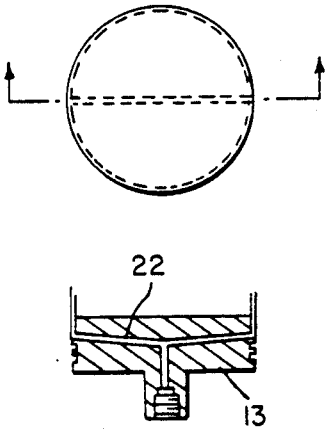
FIG. 2 shows sectional and plan views of the bottom drainage plate.

Referring now in more detail to the drawings, FIG. 1 shows a pore fluid vessel including an inner corpus ring 10 and outer corpus ring 11 permanently assembled with tapered mating surfaces 19 serving as the principal component confining a specimen sleeve 23 containing a sample to be tested. The specimen sleeve 23 can be removed and replaced. A base platen 14 supports a bottom drainage plate 13. A piston 15 translates a compression load axially to a top drainage plate 12. Specimen compression produces a reduction in pore volume and expulsion of pore fluid thru dewatering grooves 22 and extraction canals 17.

The assembly procedure begins with installing tubing fittings (not shown) onto both top and bottom drainage plates 12 and 13. The tubing length should be long enough to extend well beyond the extraction canal 17 of the base platen 14 and the piston 15. The "O" rings 20 are installed on the top and bottom drainage plates 12 and 13 while ensuring that there are no twists in the rings and that each ring is in position and wa not damaged during installation. The sample sleeve 23 should be seated well in the corpus ring assembly 10, 11 and the sample sleeve retaining ring 18 must be secure. The bottom drainage plate 13 should now be inserted into the base of the sample sleeve 23 until the trailing face of the base drainage plate 13 is flush with the end of the sample sleeve 23, using care as the drainage plate "O" rings 20 initially pass into the sample sleeve 23. The base platen 14 is bolted to the corpus ring assembly 10, 11. After the base platen 14 is secured into position, the vessel is turned on its side or into an upright position. The vessel is now ready to receive the test sample. Care should be taken in placing the test sample into the vessel to ensure that no damage to the sample sleeve 23 or to the bottom drainage plate 13 is caused by insertion of the test sample.

The top drainage plate 12 is then now be inserted into the top of the sample sleeve 23 until it contacts the test sample, using care as the drainage plate "O" rings 20 initially pass into the sample sleeve 23. The piston guide flange 21, with the piston guide 16 in place inside of it, is bolted to the corpus ring assembly 10, 11 in the same manner that the base platen 14 was secured. The piston 15 is then inserted into the receiving end of the vessel.

When axial stress is applied to the sample, fluid is forced from the tuff. The fluid exits through both ends of the tuff and enters dewatering groove 22 where it is led off through extraction canals 17 to a syringe or other collecting device. Specimen compression produces a reduction in pore volume and expulsion of pore fluid. If the pore fluid is two-phased, capillary forces hold the pore water in the sample until saturation. Then, continued compression induces in the pore water a positive pressure gradient causing the water to flow to the drainage plates.

Bidirectional drainage allows inert gas to be injected at one end of the specimen to force residual pore water to exit from the other end when the limits of mechanical compression have been reached. Gas injection produces water only when the specimen is in a state of full saturation, either naturally or through compression and expulsion of pore gas. The ability to extract pore water ceases in prior apparatus when the vessel reaches its physical limit to compress the specimen. This invention moves beyond this limitation by allowing inert gas thereafter to be injected through one of the two drainage ports to force the residual water out the other drainage port.

Testing has shown that, both for low water content and materially stiff specimens, and for the load capacity of the vessel, water extraction occurred only during the gas-injection stage, although the mechanical-compression stage was a necessary prerequisite to bring the specimen to saturation. The mechanism for extracting the residual pore water is believed to be gas displacement and/or gas-flow traction.

By providing bidirectional drainage, this invention also reduces the potential for excess pressure by effectively reducing the drainage path by one half. The shorter path also speeds completion of the test The preferred embodiment was generally fabricated from steel with the exception of the piston guide 16 which was made of bronze. Although the type of steel is not critical to the invention, the material should be strong enough to withstand the high pressures required to compress the test specimens.

While the invention has been explained with respect to a preferred embodiment thereof, it is contemplated that various changes may be made in the invention without departing from the spirit and scope thereof.

What is claimed is:

1. A bi-directionally draining pore fluid extraction vessel for forcing gas and water out of a porous solid specimen comprising:

a means for laterally and axially confining and axially compressing a porous solid specimen, said means including an outer corpus steel ring and an inner corpus steel ring, said steel rings having a substantial interference fit along matching tapered surfaces;

a steel specimen sleeve located inside said inner corpus ring for laterally confining a solid specimen within said sleeve, said sleeve being easily removable from said inner corpus ring;

said means further including a top drainage plate and a bottom draining plate for axially confining and translating axial compression to a solid specimen within said sleeve, said draining plates each having a draining port;

said means further including a piston for translating a compression load axially to said top drainage plate and thereby to a solid specimen within said sleeve;

a collecting means connected to said draining ports for collecting gas and water discharged from a solid specimen within said sleeve; and a means for injecting an inert gas into one of said top and bottom drainage ports for extracting residual water from a solid specimen within said sleeve after the load capacity of said means for laterally and axially confining and axially compressing a solid specimen has been reached.

2. A bi-directionally draining pore fluid extraction vessel for forcing gas and water out of a porous solid specimen comprising:

laterally confining steel rings including an inner corpus ring and an outer corpus ring, said inner corpus ring being loaded in compression by said outer corpus ring, said rings having a substantial interference fit along matching tapered surfaces;

a steel specimen sleeve located inside said inner corpus ring for laterally confining a solid specimen within said sleeve, said sleeve being easily removable from said inner corpus ring;

a means for axially compressing a solid specimen within said sleeve including top and bottom drainage plates and a piston for translating a compression load to said top drainage plate and thereby to a solid specimen within said sleeve to thereby displace gas and water from a solid specimen within said sleeve, said top and bottom drainage plates each having an extraction canal;

a means for injecting an inert gas into one of said top and bottom extraction canals to displace water from a solid specimen within said sleeve; and a means connected to said extraction canals for collecting displaced gas and water from a solid specimen within said sleeve.

* * * * *